US008517773B2

(12) United States Patent
Lee et al.

(10) Patent No.: US 8,517,773 B2
(45) Date of Patent: Aug. 27, 2013

(54) SATA CONNECTOR CAPABLE OF TRANSMITTING ELECTRIC POWER

(75) Inventors: Jiunn-Chang Lee, Taipei Hsien (TW); Chien-Pang Chen, Taipei Hsien (TW)

(73) Assignee: Apacer Technology Inc., New Taipei (TW)

( * ) Notice: Subject to any disclaimer, the term of this patent is extended or adjusted under 35 U.S.C. 154(b) by 73 days.

(21) Appl. No.: 12/581,319

(22) Filed: Oct. 19, 2009

(65) Prior Publication Data

US 2010/0159750 A1 Jun. 24, 2010

(30) Foreign Application Priority Data

Dec. 18, 2008 (TW) ..... 97149512 A

(51) Int. Cl.
*H01R 24/00* (2011.01)

(52) U.S. Cl.
USPC ..... 439/660

(58) Field of Classification Search
USPC ..... 439/660
See application file for complete search history.

(56) References Cited

U.S. PATENT DOCUMENTS

| | | | | |
|---|---|---|---|---|
| 2005/0048846 | A1* | 3/2005 | Suzuki et al. | 439/660 |
| 2009/0047839 | A1* | 2/2009 | Wu | 439/660 |

FOREIGN PATENT DOCUMENTS

| | | | |
|---|---|---|---|
| CN | 2862419 | Y | 1/2007 |
| CN | 101051721 | A | 10/2007 |
| CN | 201015134 | Y | 1/2008 |
| TW | M259996 | U | 3/2005 |
| TW | M328708 | U | 3/2008 |
| TW | M335045 | U | 6/2008 |
| TW | M337914 | U | 8/2008 |

OTHER PUBLICATIONS

Taiwan Official Action issued on Oct. 20, 2011.
China Official Action issued on May 25, 2011.

* cited by examiner

*Primary Examiner* — Vanessa Girardi
(74) *Attorney, Agent, or Firm* — Chun-Ming Shih; HDLS IPR Services

(57) ABSTRACT

A SATA connector capable of transmitting electric power directly includes female and male connectors. The female connector includes a body and two first power pins. A front end of the body includes a first interface with two sidewalls. An end of the first power pin is disposed on two sidewalls of the first interface, and another end of the first power pin is extended out of a rear end of the body. The male connector includes a body and two second power pins. Both sides of the body have a side groove, and the side groove has an external sidewall. The sidewall includes a notch for exposing an end of the second power pin, and another end of the second power pin is extended out of the body. When the male and female connectors are connected, the second and first power pins constitute an electric connection for transmitting electric power.

17 Claims, 10 Drawing Sheets

SATA CONNECTOR CAPABLE OF TRANSMITTING ELECTRIC POWER

BACKGROUND OF THE INVENTION

1. Field of the Invention

The present invention relates to a connector, and more particular to a serial advanced technology attachment (SATA) connector capable of transmitting electric power directly.

2. Description of Prior Art

Compared with a traditional parallel integrated device electronic (IDE) transmission, a serial advanced technology attachment (SATA) transmission has the advantages of a higher speed (wherein the highest speed of an ATA hard disk is approximately 133 MHz, and the highest speed of an SATA hard disk is 150 MHz or above), a smaller and more slender flat cable, a better heat dissipation, and a lower power consumption, and thus SATA hard disk has become a new-generation high-speed hard disk.

At present, a SATA disk module 10 as shown in FIG. 1 includes a second printed circuit board 20 with a side electrically coupled to a male connector (such as a 7-pin connector) of a SATA connector 30, and another side electrically coupled to a power connector 40 (such as a 2-pin connector). When the SATA disk module 10 is installed inside a casing of an electronic device, the male connector 30 (7-pin connector) of the SATA connector is connected to a female connector of a SATA connector installed on a first printed circuit board, and then a power line is inserted and connected to the power connector 40 (2-pin connector) for supplying a required electric power to the SATA disk module 10. Although connectors of this sort divide power and signal transmissions into independent connectors to provide a high sharability of the SATA disk module 10, yet the connectors also incur a complicated assembling process and a higher manufacturing cost.

To make the installation of a SATA disk module 10 easier, and lower the manufacturing cost, manufacturers generally use one of the pins of the male connector 30 of the SATA connector for transmitting electric power. However, such arrangement also causes a low sharability of the SATA disk module 10 and may even burn the SATA disk module 10 in some serious cases.

SUMMARY OF THE INVENTION

Therefore, it is an objective of the present invention to overcome the shortcomings of the prior art by providing a SATA connector capable of transmitting electric power directly, such that the SATA disk module can save the manufacture of a power connector and achieve the effects of making the manufacture of the SATA disk module much easier and lowering the cost. In the meantime, both male and female connectors of the SATA connector can be connected more securely. The invention can achieve the effects of providing a high sharability of the SATA disk module, eliminating the risk of burning the SATA disk module, improving the safety of use, and allowing manufacturers to manufacture the connectors with a minimal correction.

To achieve the foregoing objective, the present invention provides a SATA connector capable of transmitting electric power directly, comprising:

a female connector, having a body thereon, a first interface disposed at a front end of the body, and two sidewalls formed in the first interface;

two first power pins, each having an end disposed separately on two sidewalls of the first interface, and another end extended out of a rear end of the body;

a male connector, having a body disposed thereon, a side groove disposed separately on both sides of the body, an external sidewall formed at the side groove, and a notch formed on the sidewall; and two second power pins, having an end installed onto and exposed from the notch, and another end extended out of the body;

wherein if the male and female connectors are connected, the second and first power pins will be electrically coupled to each other for transmitting electric power.

DETAILED DESCRIPTION OF THE INVENTION

The technical characteristics, features and advantages of the present invention will become apparent in the following detailed description of the preferred embodiments with reference to the accompanying drawings. The drawings are provided for reference and illustration only, but not intended for limiting the present invention.

The present invention provides a SATA female connector for transmitting electric power directly, wherein if a male connector is plugged into the female connector, a first signal pin installed on the female connector is electrically coupled to the male connector and provided for transmitting a SATA signal, and a first power pin is installed onto a sidewall inside the female connector, such that when the male and female connectors are connected, the first power pin is electrically coupled to the male connector for transmitting electric power. The present invention also provides a SATA male connector for transmitting electric power directly, wherein if the male connector is plugged into a female connector, a second signal pin installed on the male connector is electrically coupled to the female connector for transmitting a SATA signal, and a second power pin is installed on a sidewall outside the male connector, such that when the male and female connectors are connected, the second power pin is electrically coupled to the female connector for transmitting electric power. The male and female connectors of the present invention can be installed at an end of a transmission line, or installed on a printed circuit board or a main board, and the power source pin is provided for transmitting electric power to the printed circuit board or the main board.

Related technical contents and detailed description of the present invention are elaborated with accompanying drawings as follows.

Figure 1:
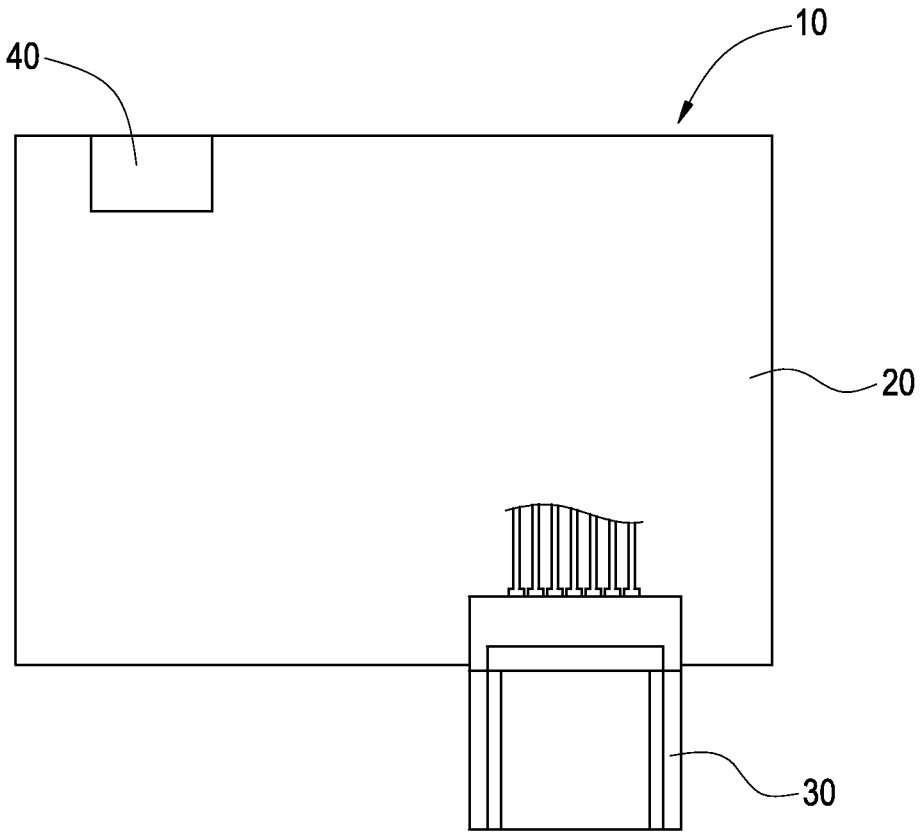
FIG.1 PRIOR ART
FIG. 1 is a schematic view of using a conventional SATA connector.
Figure 2:
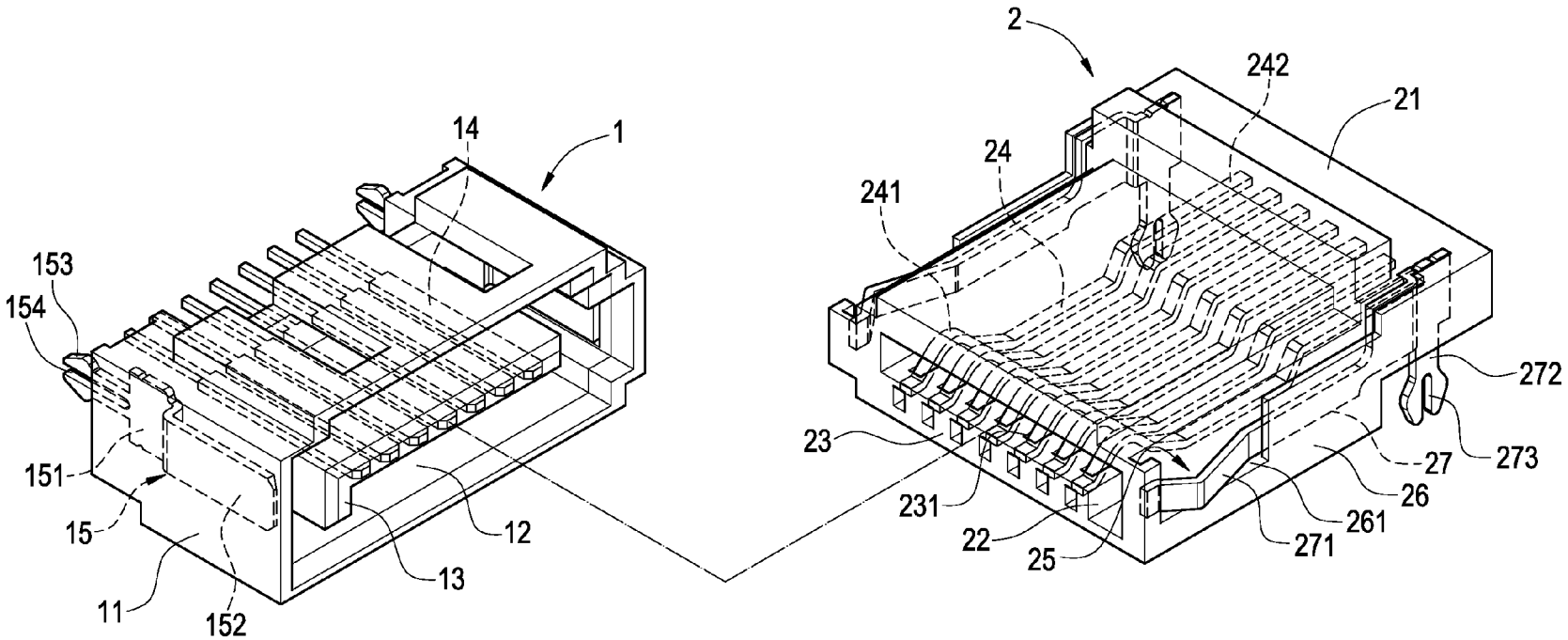
FIG. 2 is an exploded view of a SATA connector of the present invention.

With reference to FIG. 2 for an exploded view of a SATA connector in accordance with the present invention, the SATA connector 10 capable of transmitting electric power directly comprises a female connector 1 and a male connector 2.

The female connector 1 includes a body 11 formed thereon, and the body 11 includes a first interface 12 disposed at a front end of the body 11, and the first interface 12 includes an L-shaped retaining board 13, and the retaining board 13 includes a plurality of pins 14, and an end of the plurality of pins 14 is extended out of a rear end of the body 11. In addition, two symmetric first power pins 15 are installed on two sidewalls of the first interface 12 of the body 11 respectively, and the first power pin 15 includes a latch portion 151, and an end of the latch portion 151 is extended to a contact portion 152 on the sidewall, and another end of the latch portion 151 is extended to a rear end of the body 11 to form a fixed portion 153, and the fixed portion 153 includes an open-end slot 154. In FIG. 2, the fixed portion 153 is harpoon-shaped.

The male connector 2 includes a body 21 formed thereon, and the body 21 includes a second interface 22 disposed at a front end of the body 21 and connector to the retaining board 13, and the second interface 22 includes a protrusion 23, and the protrusion 23 includes a plurality of grooves 231, and the plurality of grooves 231 include a plurality of pins 24 installed therein respectively, and a front section 241 of the pin 24 is substantially in an arc shape and protruded out of the groove 231, and a rear-section portion 242 of the pin 24 is extended out of a rear end of the body 21. In addition, a side groove 25 is formed separately on both sides of the body 21, and the side groove 25 includes an external sidewall 26, and the sidewall 26 includes a notch 261. In addition, the two side grooves 25 have a second power pin 27 installed therein separately, and a front section of the second power pin 27 includes a bent section 271installed in the notch 261, and a rear section of the second power pin 27 includes a fixed section 272 extended out of the body 21, and the fixed section 272 includes an open-end slot 273. In FIG. 2, the fixed section 272 is harpoon shaped.

If the aforementioned female connector 1 and the male connector 2 are connected, a contact portion 152 of the first power pin 15 will be in contact with a bent section 271 of the second power pin 27, such that an electric power passed through the first power pin 15 can be transmitted to the second power pin 27.

Figure 3:
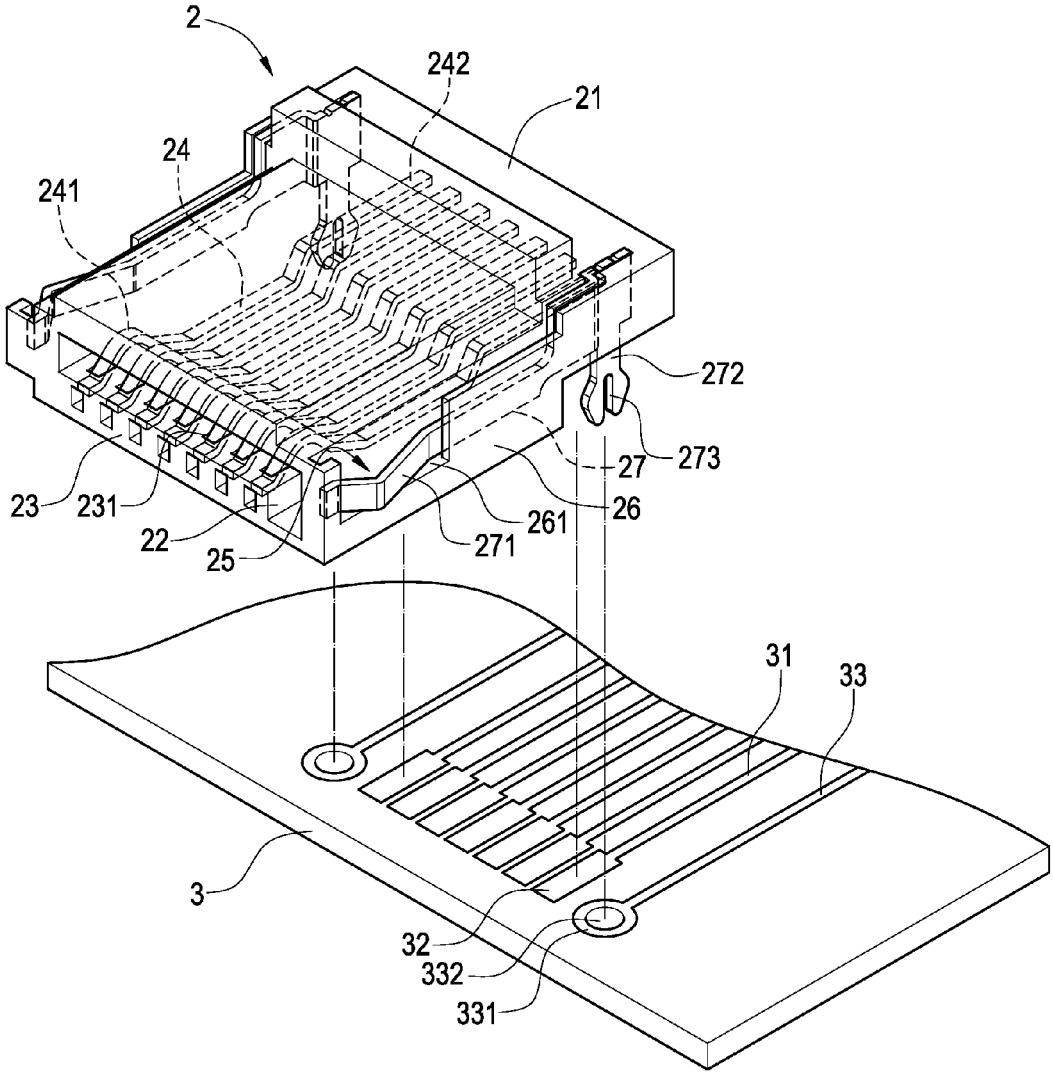
FIG. 3 is a schematic view of electrically connecting a male connector of a SATA connector to a second printed circuit board of a hard disk module in accordance with the present invention.

With reference to FIG. 3 for a schematic view of electrically connecting a male connector of a SATA connector to a second printed circuit board of a hard disk module in accordance with the present invention, the male connector 2 is electrically coupled to the second printed circuit board 3, and the second printed circuit board 3 includes a plurality of signal transmission copper wires 31, and an end of the signal transmission copper wire 31 has a solder joint 32 electrically coupled to a rear-section portion 242 of the plurality of pins 24. In addition, the second printed circuit board 3 includes a second power copper wire 33, and an end of the second power copper wire 33 includes a fixed contact point 331, and the fixed contact point 331 includes a through hole 332 provided for passing the fixed section 272 of the second power pin 27 to electrically couple the fixed contact point 331.

Figure 4:
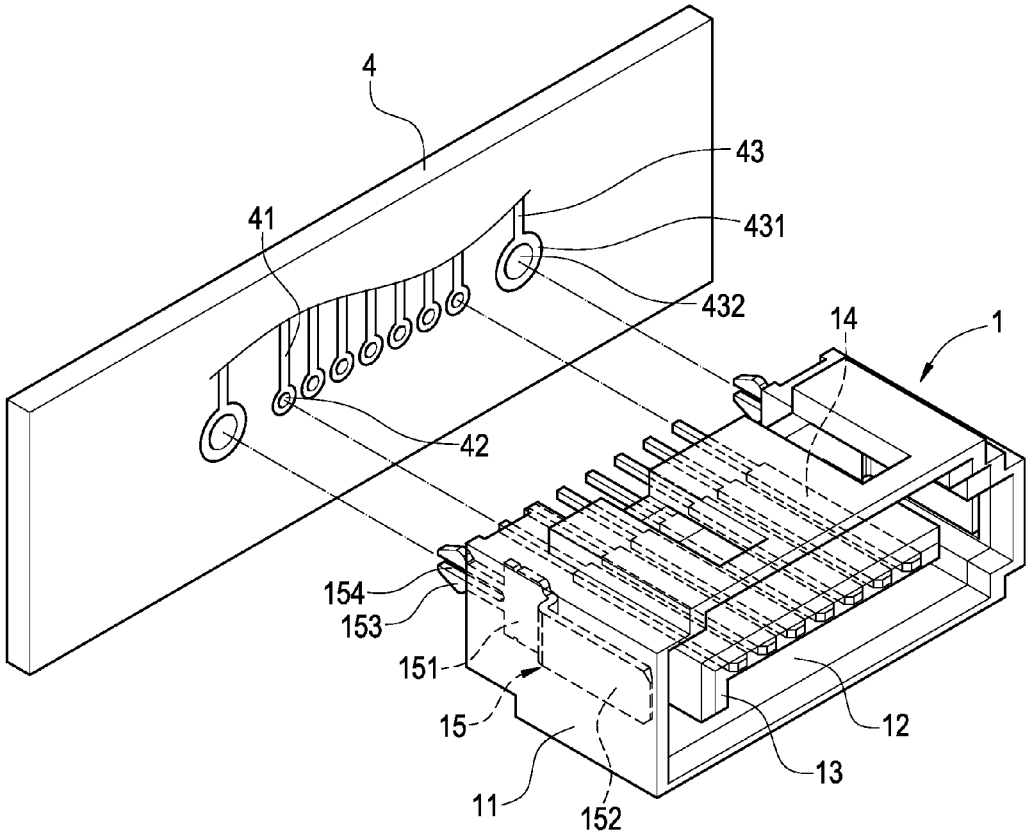
FIG. 4 is a schematic view of electrically connecting a female connector of a SATA connector to a first printed circuit board of an electronic device in accordance with the present invention.

With reference to FIG. 4 for a schematic view of electrically connecting a female connector of a SATA connector to a first printed circuit board of an electronic device in accordance with the present invention, the female connector 2 is electrically coupled to a first printed circuit board 4, and the first printed circuit board 4 includes a plurality of signal transmission copper wires 41, and an end of the signal transmission copper wire 41 has a solder joint 42 disposed at the rear-section portion 242 electrically coupled to the plurality of pins 241. In addition, the first printed circuit board 4 includes a first power copper wire 43, wherein an end of the first power copper wire 43 has a fixed contact point 431, and the fixed contact point 431 has a through hole 432 provided for passing the fixed portion 272 of the first power pin 15 and electrically coupling the fixed contact point 431.

Figure 5:
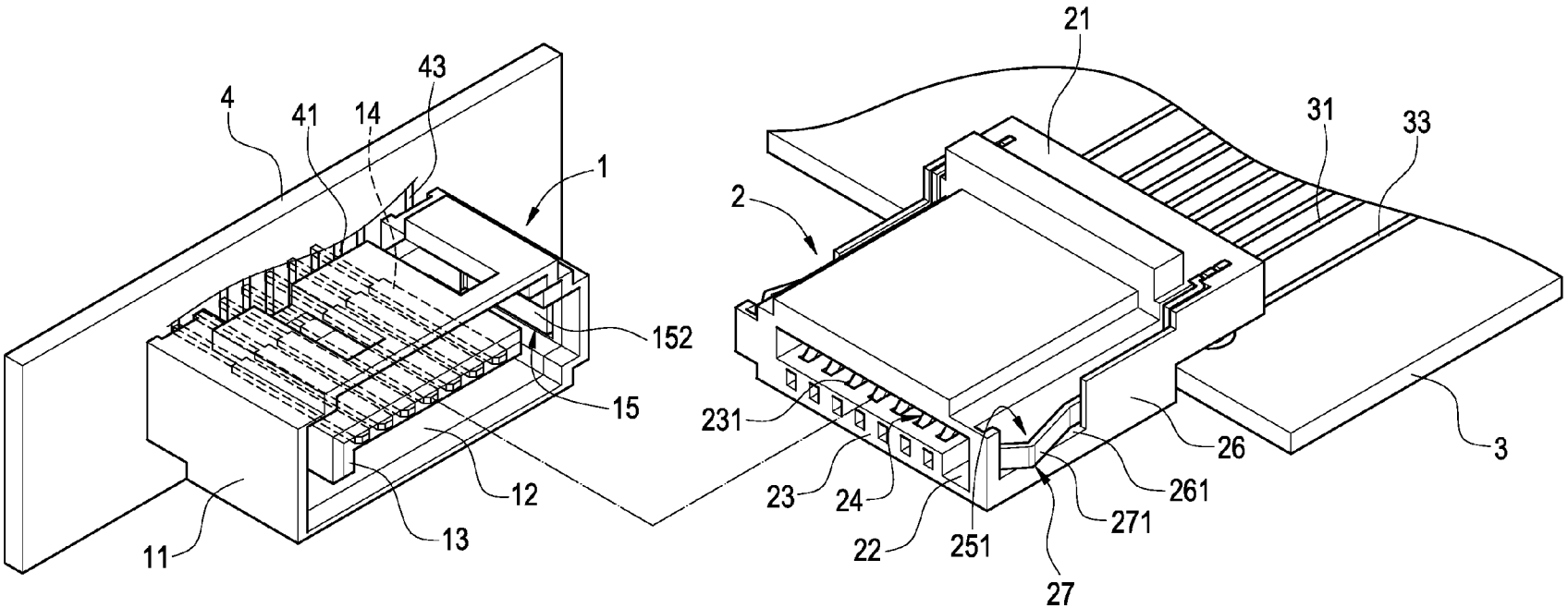
FIGS. 5 to 7 for cross-sectional views of plugging a male connector into a female connector of a SATA connector in accordance with the present invention.
Figure 6:
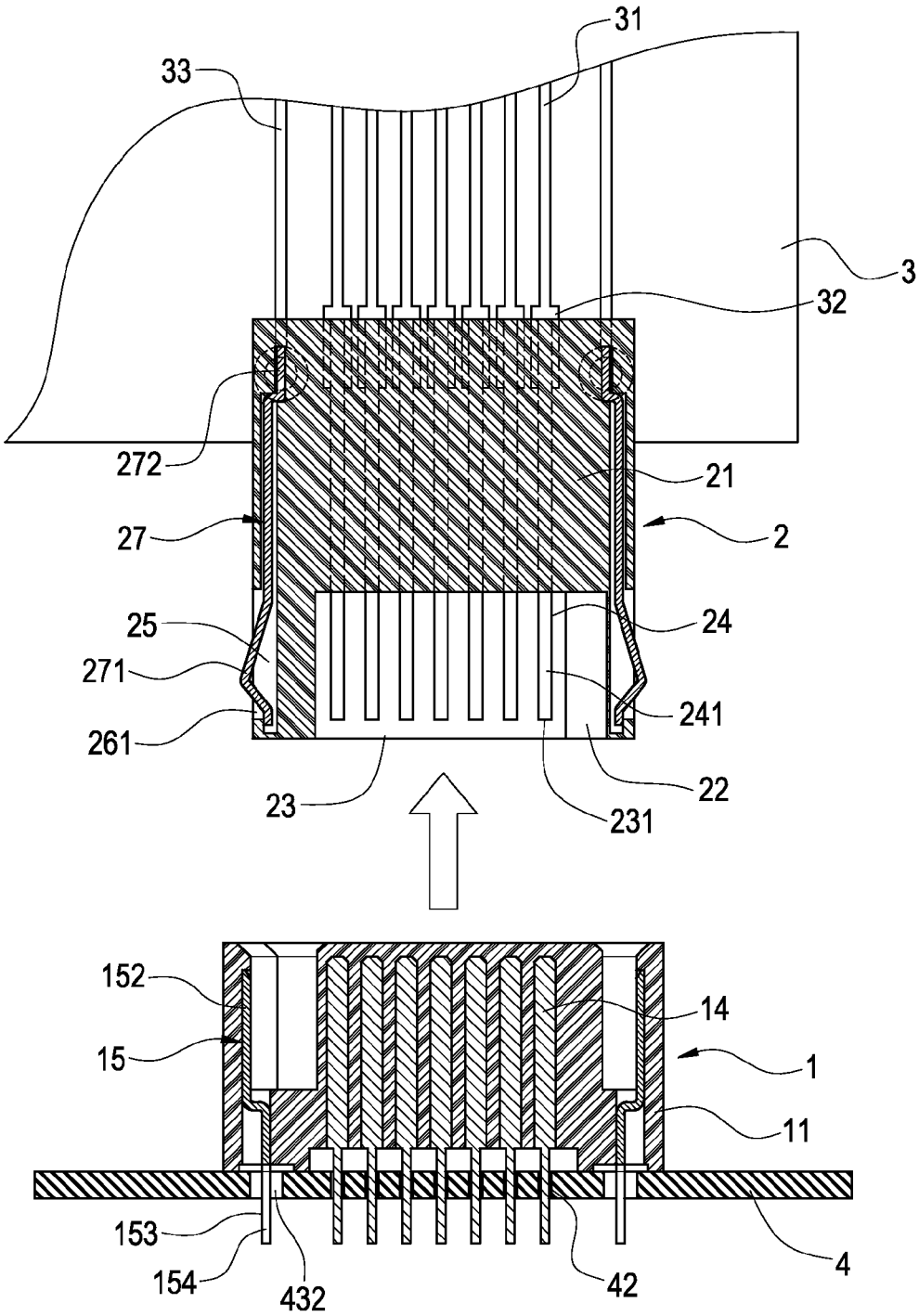
Figure 7:
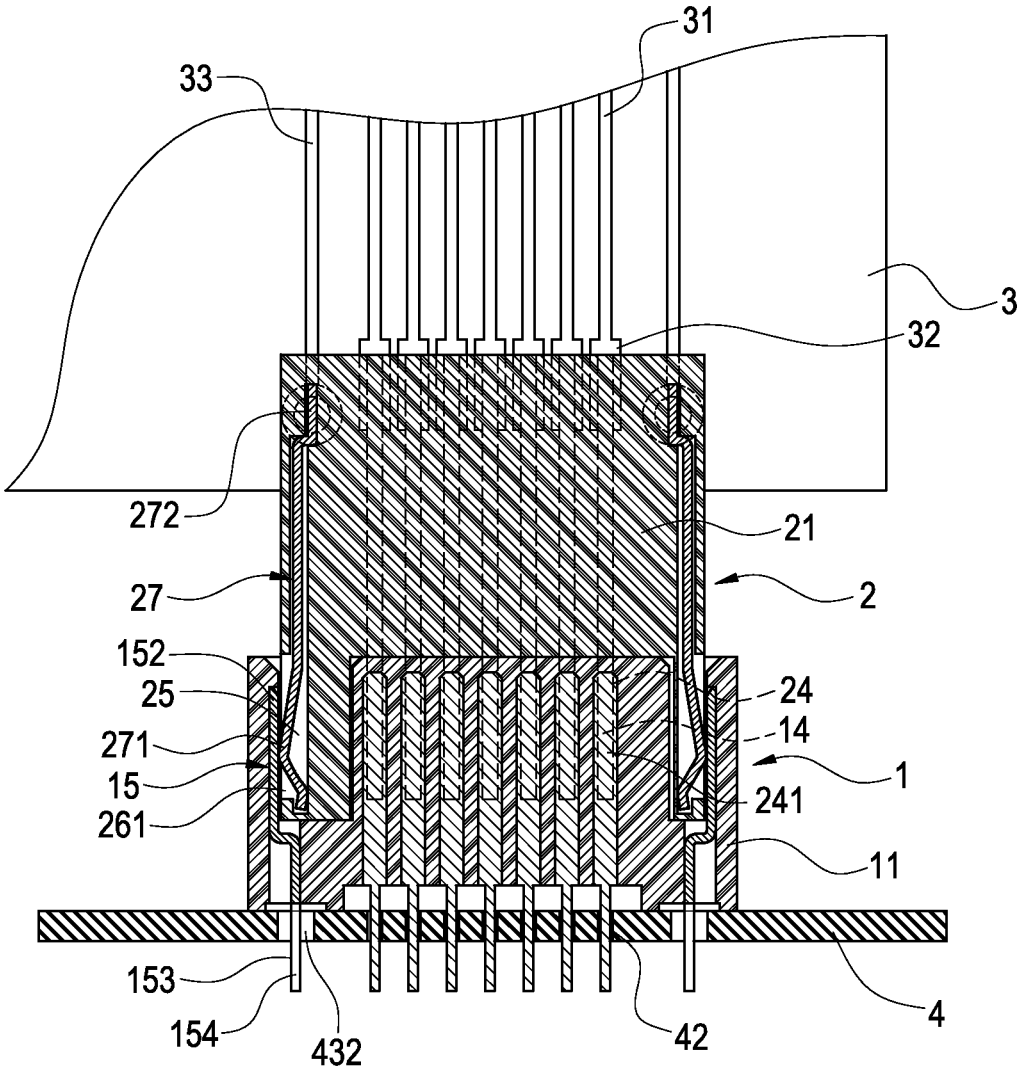

With reference to FIGS. 5 to 7 for cross-sectional views of plugging a male connector into a female connector of a SATA connector in accordance with the present invention, after the female connector 1 is electrically coupled to the first printed circuit board 4 and the male connector 2 is electrically coupled to the second printed circuit board 3, the female connector 1 and the male connector 2 are connected. When the female connector 1 and the male connector 2 are connected with each other, the contact portion 152 of the first power pin 15 is in contact with the bent section 271 of the second power pin 27. After an electric power of the first printed circuit board 4 is passed through the first power copper wire 43 to the first power pin 15, and then transmitted from the contact portion 152 of the first power pin 15 to the bent section 271 of the second power pin 27, the electric power is transmitted to the power copper wire 33 on the second printed circuit board 3 through the second power pin 272 for supplying the required electric power to electronic components installed on the second printed circuit board 3.

Since the electric power of the aforementioned second printed circuit board 3 is provided directly by the male connector and the female connector of the SATA connector, therefore the SATA disk module no longer needs a connection of an external power cable, and the first power pin 15 is in contact with the second power pin 27 to connect the female connector 1 and the male connector 2 more securely, such that the SATA disk module has the advantages of providing a high sharability, reducing the risk of burning the SATA disk module, and improving the safety of use. In addition, system manufacturers can make corrections with minimal changes to achieve the effect of supplying electric power directly from the SATA connector.

Figure 8:
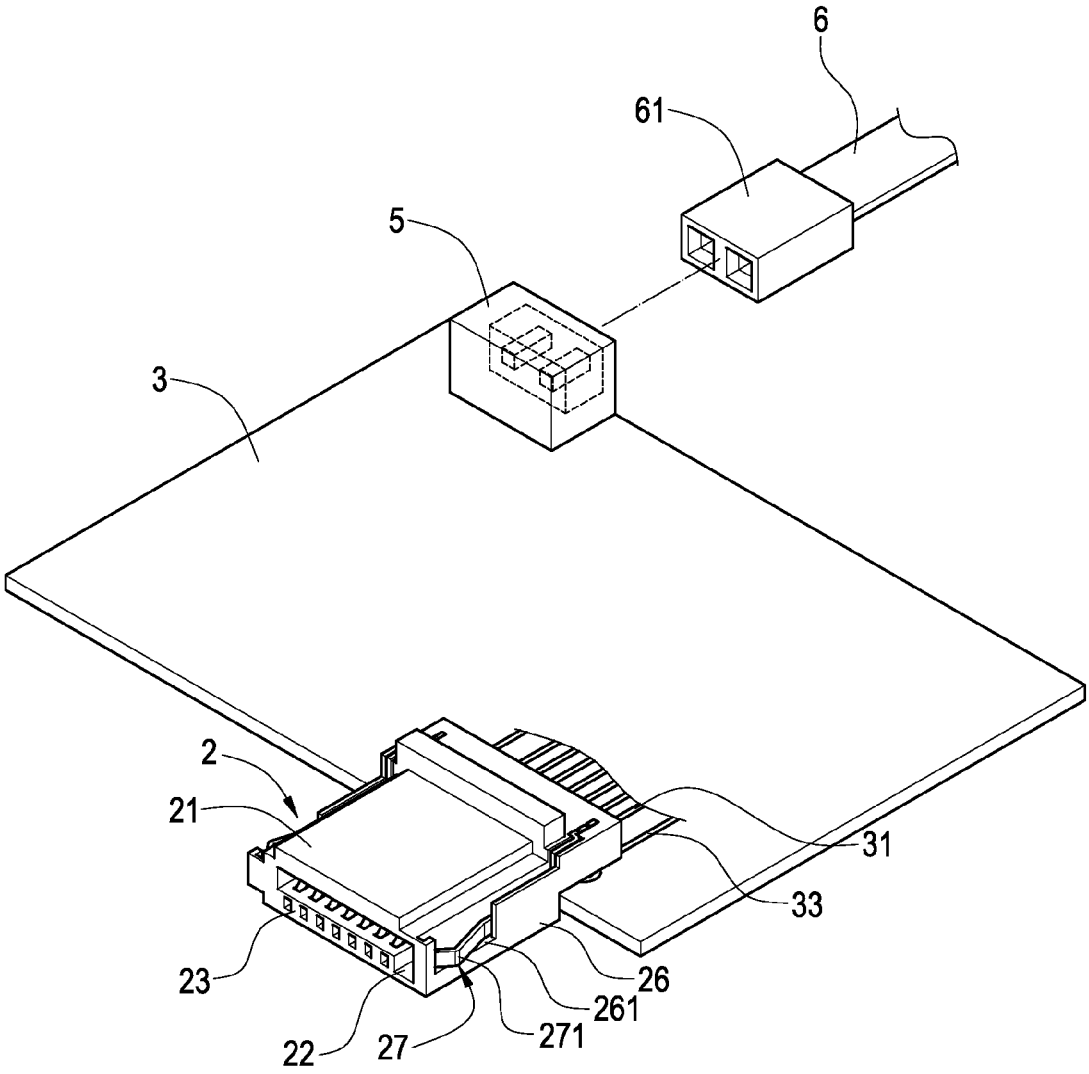
FIG. 8 is a schematic view of another preferred embodiment of the present invention.

With reference to FIG. 8 for a schematic view of another preferred embodiment of the present invention, the second printed circuit board 3 reserves the original power connector 5, such that when the male connector 2 is plugged into a female connector 1 that is incapable of supplying electric power directly, the second printed circuit board 3 can be connected through the power connector 5 and an electric connector 61 of the power conductive line 6 of an electronic device for supplying the required electric power to the second printed circuit board 3, or the required electric power is supplied to the second printed circuit board 3 by an external power adapter or a battery power supply.

Figure 9:
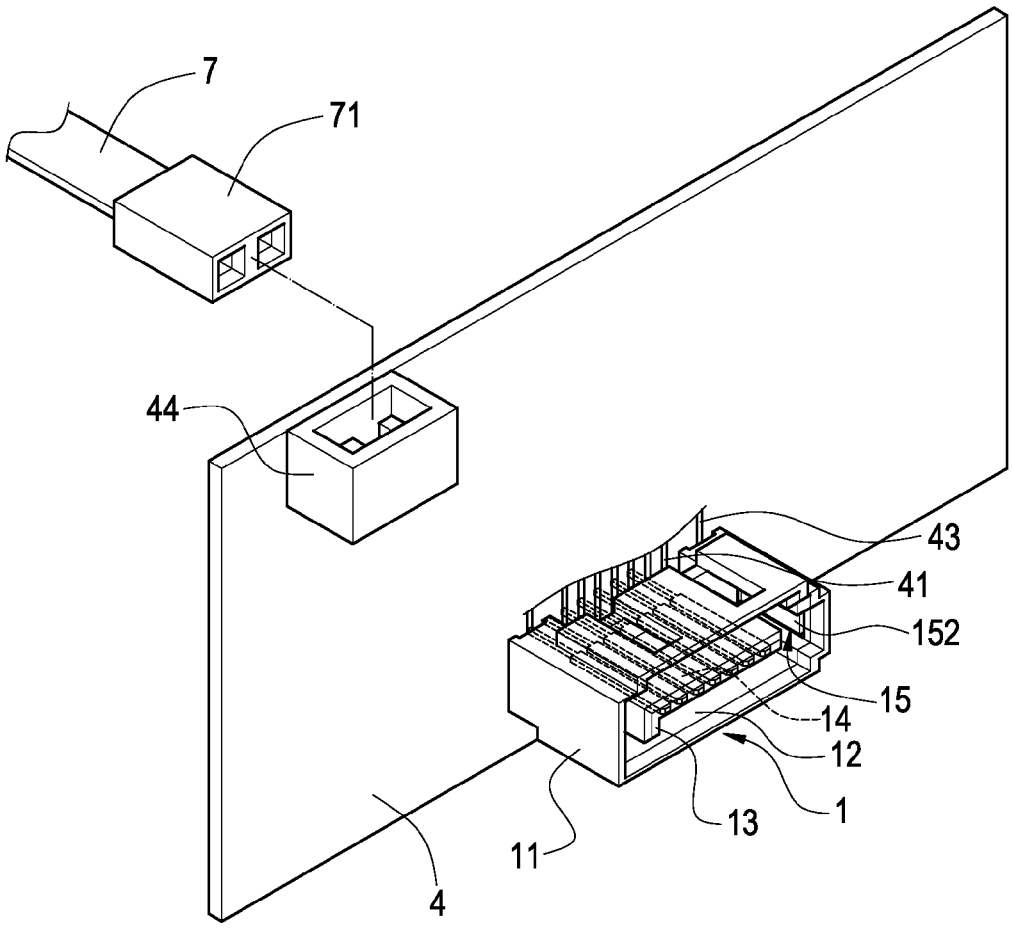
FIG. 9 is a schematic view of a further preferred embodiment of the present invention.

With reference to FIG. 9 for a schematic view of a further preferred embodiment of the present invention, if the female connector 1 and the first printed circuit board 4 are electrically coupled with each other, the first printed circuit board 4 can include an additional power connector 44 for connecting an electric connector 71 of the power conductive line 7 of the electronic device, or an external power adapter or a battery power supply is provided for supplying the required electric power to the first printed circuit board 4. When the female connector 1 of the first printed circuit board 4 is connected to the male connector of the present invention, the required electric power can be supplied to the male connector electrically coupled to the second printed circuit board.

Figure 10:
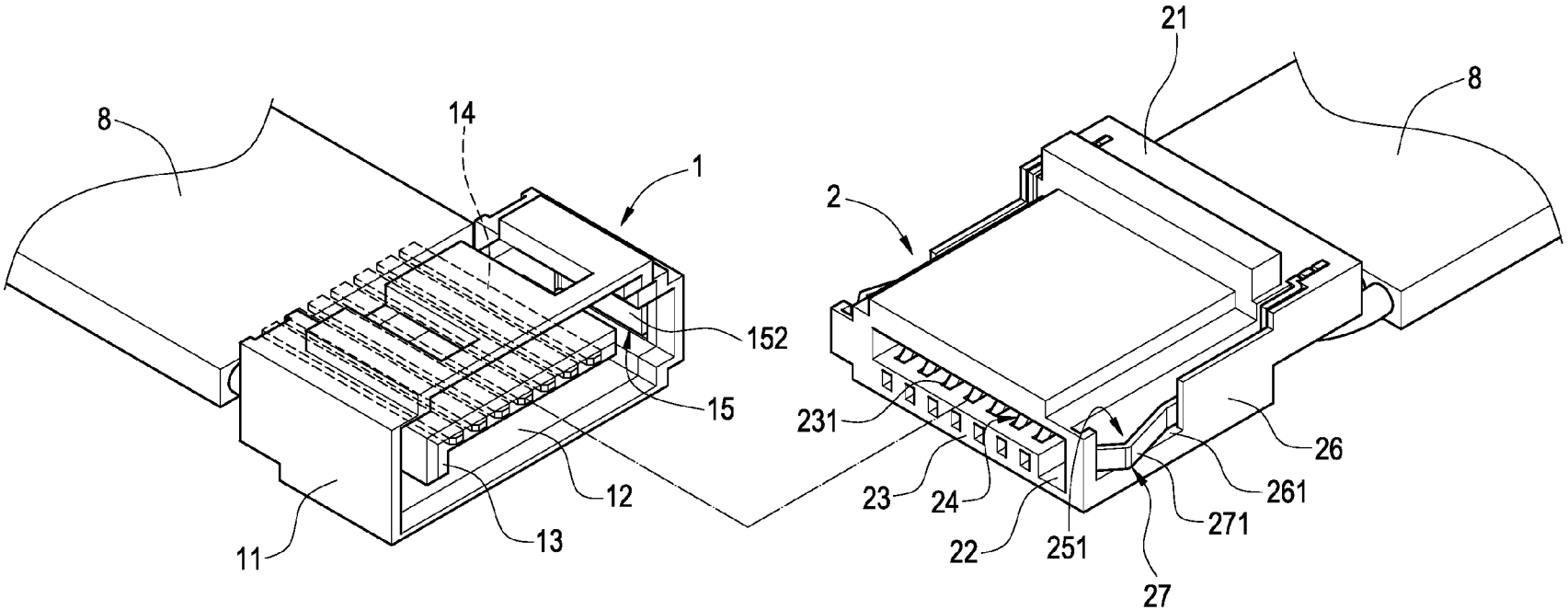
FIG. 10 is a schematic view of another further preferred embodiment of the present invention.

With reference to FIG. 10 for a schematic view of another further preferred embodiment of the present invention, the female connector 1 and the male connector 2 of the SATA connector can be electrically coupled to the second printed circuit board 3 and the first printed circuit board 4 in accordance with the present invention, and the plurality of pins 14 of the female connector 1 and the first power pin 15, and the plurality of pins 24 of the male connector 2 and the second power pin 27 can also be electrically coupled to a transmission line 8 (such as a flat cable or an electric cable).

In addition, the female connector of the present invention is not limited to its electric connection with the first printed circuit board of an electronic device or the first printed circuit board including a power connector only, but the female connector can also be electrically connected to the second printed circuit board of a hard disk or the second printed circuit board of a hard disk including a power connector. Similarly, the male connector is not limited to its electric connection with the second printed circuit board of a hard disk or a second printed circuit board including a power connector only, but the male connector can also be electrically coupled to the first printed circuit board of an electronic device or an electronic device including a first printed circuit board connected to a power source. In other words, the male and female connectors of present invention can be interchanged in an application.

In summation of the description above, the present invention improves over the prior art and complies with patent application requirements, and thus is duly filed for patent application.

The present invention is illustrated with reference to the preferred embodiment and not intended to limit the patent scope of the present invention. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A serial advanced technology attachment (SATA) connector capable of transmitting electric power directly, comprising:

a female connector, having a body formed thereon, a first interface installed at a front end of the body, and two sidewalls formed in the first interface;

two first power pins, each having an end disposed separately on two sidewalls of the first interface, and another end extended to a rear end of the body, wherein the another end has a harpoon-shaped fixed portion with a tapered width.

2. The SATA connector of claim 1, wherein the first power pin includes a latch portion, and an end of the latch portion is extended with a contact portion on the sidewall, and another end of the latch portion is extended out of the rear end of the body to form the fixed portion, and the fixed portion includes an open-end slot so as to form the harpoon-shaped fixed portion.

3. The SATA connector of claim 1, wherein the first interface includes an L-shaped retaining board, and the retaining board includes the plurality of pins, and an end of each pin is extended out of the rear end of the body.

4. The SATA connector of claim 3, further comprising a printed circuit board, and the printed board including a plurality of signal transmission copper wires and a set of power copper wires, wherein a through hole is formed on each power copper wire, and the signal transmission copper wires are electrically coupled to a plurality of pins of the female connector respectively, and each power copper wires is electrically coupled to one first power pin of the female connector by engaging the harpoon-shaped fixed portion into the through hole.

5. The SATA connector of claim 4, wherein the printed circuit board includes a power connector installed thereon.

6. The SATA connector of claim 5, wherein the power connector is electrically coupled to an electric connector of an external power conductive line, a power adapter, or a battery power supply.

7. A serial advanced technology attachment (SATA) connector capable of transmitting electric power directly, comprising a female connector and a male connector, such that when the male and female connectors are connected, a first signal pin installed on the female connector is electrically coupled to a second signal pin installed on the male connector for transmitting a SATA signal, characterized in that:

the female connector includes a first power pin installed onto an internal sidewall, the first power pin having a distal end with a first harpoon-shaped fixed portion with a tapered width; and the male connector includes a second power pin installed onto an external sidewall, the second power pin having a distal end with a second harpoon-shaped fixed portion with a tapered width;

such that when the male and female connectors are coupled to each other, the second and first power pins are electrically coupled to each other for transmitting an electric power.

8. A serial advanced technology attachment (SATA) connector capable of transmitting electric power directly, comprising:

a male connector, having a body formed thereon, a side groove formed separately on both sides of the body, an external sidewall formed on the side groove, and a notch formed on the sidewall;

two second power pins, each having an end installed onto and exposed from the notch, and another end extended vertically to a rear end of the body, wherein the another end has a harpoon-shaped fixed portion with a tapered width.

9. The SATA connector of claim 8, wherein the second power pin includes a bent section disposed at a front section of the second power pin, and a fixed section disposed at a rear section of the second power pin and extended out of the body, and the fixed section includes an open-end slot so as to form the harpoon-shaped fixed portion.

10. The SATA connector of claim 8, wherein the body of the male connector includes a second interface disposed at a front end of the body and coupled to a retaining board formed on a first interface of a female connector, and the second interface includes a protrusion, and the protrusion includes a plurality of grooves, and the plurality of grooves include the plurality of pins installed therein respectively, and a front section of each pin is substantially in an arc shape and protruded out of the groove, and a rear-section portion of each pin is extended out of the rear end of the body.

11. The SATA connector of claim 10, further comprising a printed circuit board, and the printed board including a plurality of signal transmission copper wires and a set of power copper wires, wherein a through hole is formed on each power copper wire, and the signal transmission copper wires are electrically coupled to a plurality of pins of the male connector respectively, and each power copper wire is electrically coupled to one second power pin of the male connector by engaging the harpoon-shaped fixed portion into the through hole.

12. The SATA connector of claim 11, wherein the printed circuit board includes a power connector installed thereon.

13. The SATA connector of claim 12, wherein the power connector is electrically coupled to an electric connector of an external power conductive line, a power adapter, or a battery power supply.

14. An electrical device having a serial advanced technology attachment (SATA) connector capable of transmitting electric power directly, comprising:

a female connector, such that when the female connector is connected to a male connector, a first signal pin installed on the female connector and a second signal pin installed on the male connector are electrically coupled to each other for transmitting a SATA signal, characterized in that:

the female connector includes a first power pin installed onto an internal sidewall, the first power pin having a distal end with a harpoon-shaped fixed portion;

such that when the male and female connectors are connected, the first power pin is electrically coupled to the male connector for transmitting an electric power;

the electrical device further comprises a main board, the main board having at least a through hole and a power connector;

wherein the harpoon-shaped fixed portion is engaged into the through hole such that the female connector is fixed on the main board;

wherein an electric power input from the power connector is conveyed to the female connector through the first power pin.

15. The electrical device of claim 14, wherein the female connector is installed at an end of a transmission line.

16. An electrical device having a serial advanced technology attachment (SATA) connector capable of transmitting electric power directly, comprising a male connector, such that if the male connector is plugged into a female connector, a second signal pin installed on the male connector and the female connector constitute an electric connection for transmitting a SATA signal, characterized in that:

an external sidewall of the male connector includes a second power pin, the second power pin having a distal end with a harpoon-shaped fixed portion;

wherein when the male and female connectors are connected to each other, the second power pin is electrically coupled to the female connector for transmitting an electric power;

the electrical device further comprises a printed circuit board, the printed circuit board having at least a through hole and a power copper wire;

wherein the harpoon-shaped fixed portion is engaged into the through hole such that the male connector is fixed on the printed circuit board and the second power pin is electrically connected to the power copper wire;

wherein an electric power sent from the female connector is conveyed to the printed circuit board through the second power pin.

17. The electrical device of claim 16, wherein the male connector is installed at an end of a transmission line.

* * * * *